US010363743B2

(12) United States Patent
Ozawa et al.

(10) Patent No.: US 10,363,743 B2
(45) Date of Patent: Jul. 30, 2019

(54) LIQUID EJECTING HEAD HAVING NOZZLE WITH ELECTROSTATIC PROPENSITY

(71) Applicant: SEIKO EPSON CORPORATION, Tokyo (JP)

(72) Inventors: Kinya Ozawa, Shiojiri (JP); Kazuhiko Hara, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 7 days.

(21) Appl. No.: 15/601,862

(22) Filed: May 22, 2017

(65) Prior Publication Data

US 2017/0341396 A1 Nov. 30, 2017

(30) Foreign Application Priority Data

May 24, 2016 (JP) ..... 2016-103152

(51) Int. Cl.

| | |
|---|---|
| ***B41J 2/14*** | (2006.01) |
| ***B41J 2/035*** | (2006.01) |
| ***B41J 2/16*** | (2006.01) |
| *B41J 2/045* | (2006.01) |

(52) U.S. Cl.

CPC ..... *B41J 2/14451* (2013.01); *B41J 2/035* (2013.01); *B41J 2/14314* (2013.01); *B41J 2/161* (2013.01); *B41J 2/0458* (2013.01); *B41J 2/14* (2013.01); *B41J 2002/14258* (2013.01)

(58) Field of Classification Search

CPC ..... B41J 2/14451; B41J 2/161; B41J 2/035; B41J 2/14314; B41J 2002/14258; B41J 2/14; B41J 2/0458

See application file for complete search history.

(56) References Cited

U.S. PATENT DOCUMENTS

| | | | | |
|---|---|---|---|---|
| 5,594,479 | A | 1/1997 | Inoue et al. | |
| 5,798,778 | A | 8/1998 | Kimura et al. | |
| 6,767,078 | B2 * | 7/2004 | Sato | B41J 2/1606 347/45 |
| 7,325,902 | B2 | 2/2008 | Tamahashi et al. | |
| 2012/0132231 | A1 | 5/2012 | Matsumoto et al. | |
| 2013/0002754 | A1 * | 1/2013 | Aruga | B41J 2/1433 347/24 |
| 2014/0253640 | A1 * | 9/2014 | Yokoyama | B41J 2/14233 347/70 |
| 2016/0144628 | A1 * | 5/2016 | Sato | B41J 2/17596 347/85 |

FOREIGN PATENT DOCUMENTS

| | | |
|---|---|---|
| JP | 04-211959 | 8/1992 |
| JP | 6-43132 | 6/1994 |
| JP | 6-210859 | 8/1994 |
| JP | 11-268248 | 10/1999 |
| JP | 2004-155082 | 6/2004 |

(Continued)

*Primary Examiner* — Henok D Legesse
(74) *Attorney, Agent, or Firm* — Workman Nydegger

(57) ABSTRACT

A liquid ejecting head has a nozzle forming surface to which a nozzle section through which liquid is ejected is open, wherein an electrostatic propensity of the nozzle section due to contact with the liquid is lower than an electrostatic propensity of the nozzle forming surface due to contact with the liquid. The amount of fluorine per unit area in the nozzle section is smaller than the amount of fluorine per unit area in the nozzle forming surface.

15 Claims, 7 Drawing Sheets

(56) References Cited

FOREIGN PATENT DOCUMENTS

| | | |
|---|---|---|
| JP | 2005-007789 | 1/2005 |
| JP | 2005-145057 | 6/2005 |
| JP | 2007-021840 | 2/2007 |
| JP | 2007-331127 | 12/2007 |
| JP | 2012-116001 | 6/2012 |
| JP | 2015-085616 | 5/2015 |

* cited by examiner

LIQUID EJECTING HEAD HAVING NOZZLE WITH ELECTROSTATIC PROPENSITY

BACKGROUND

1. Technical Field

The present invention relates to a liquid ejecting head mounted on an ink jet recording apparatus or the like, and a liquid ejecting apparatus. More specifically, the present invention relates to a liquid ejecting head having a nozzle forming surface to which a nozzle section is open, and a liquid ejecting apparatus.

2. Related Art

Liquid ejecting heads that eject liquid droplets from nozzles by changing a pressure of liquid in a pressure chamber include, for example, ink jet recording heads (hereinafter, simply referred to as recording heads) used for image recording apparatuses such as ink jet recording apparatuses (hereinafter, simply referred to as printers), color material ejection heads used for manufacturing color filters for liquid crystal displays and the like, electrode material ejection heads used for manufacturing electrodes for organic electroluminescence (EL) displays, field emission displays (FEDs) and the like, and bioorganic ejection heads used for manufacturing biochips (biochemistry element) and the like. The recording heads for image recording apparatuses are configured to eject ink in the liquid form, and the color material ejecting heads for display manufacturing devices are configured to eject solution of each color material of red (R), green (G), and blue (B). Further, electrode material ejection heads for electrode forming apparatuses are configured to eject an electrode material in the liquid form, and bioorganic ejection heads for biochip manufacturing apparatuses are configured to eject solution of a bioorganic material.

As described in JP-A-2012-116001, the liquid ejecting apparatus having the liquid ejecting head may perform a cleaning process to forcibly discharge thickened liquid or air bubbles from a nozzle section of the liquid ejecting head. More specifically, while a cap is brought into contact with a nozzle forming surface to which the nozzle section of the liquid ejecting head is open, a negative pressure is generated inside the cap by means of a suction unit so that thickened liquid or air bubbles inside the liquid ejecting head is discharged from the nozzle section. In this cleaning process, a large amount of liquid is discharged into the cap at a time, which may cause the liquid to splash or sputter onto the nozzle forming surface. Accordingly, subsequent to the cleaning process, a wiping process is performed by a wiping member to wipe off the nozzle forming surface. In this liquid ejecting head, a liquid repellent film is provided on the nozzle forming surface in order to improve wiping of the liquid attached on the nozzle forming surface during the wiping process or reduce an occurrence of ejection failure such as curved flying which is caused by the liquid attached on the nozzle forming surface. Accordingly, liquid repellent properties of the nozzle forming surface are enhanced. As described in Japanese Patent No. 4635554, the liquid repellent film includes that formed by combining a fluorine silane coupling agent with a hydroxyl group on the nozzle forming surface.

Since fluorine is in a negative position in the triboelectric series, the liquid repellent film including fluorine tends to be negatively charged by contact or friction with liquid. When the above cleaning process is complete and suctioning by the suction unit stops, the inner flow passage in the liquid ejecting head is held at a negative pressure to a certain extent. Accordingly, the liquid attached to the nozzle forming surface is suctioned from the nozzle section into the flow passage. Here, since the liquid attached to the nozzle forming surface is suctioned while being in contact with the liquid repellent film of the nozzle forming surface, a portion of the liquid repellent film which is in contact with the liquid is negatively charged due to frictional electrostatic charge by the liquid. When liquid is ejected in this state from the nozzle section, the liquid is positively charged, which is opposite polarity from that (negative polarity) of the charged site, due to electrostatic induction of the charged site. As a result, there has been a problem that, when a liquid ejection target is positively charged, fine mist generated along with liquid ejection tends to be attached on the nozzle forming surface of the liquid ejecting head. In particular, when a recording medium or the like, which is a liquid ejection target, is charged at the same potential as the ejected liquid, the recording medium repels the liquid. Consequently, the liquid further tends to be attached on the nozzle forming surface. This problem is more prominent since electrostatic discharge is difficult when the electric conductivity of the ejected liquid is lower than that of water (tap water: $1.0\times 10^{-2}$ [S/m]).

SUMMARY

An advantage of some aspects of the invention is that a liquid ejecting head that can reduce electrostatic charging of liquid ejected from a nozzle section, and a liquid ejecting apparatus are provided.

The present invention has been made to overcome the above problem, and an aspect of the present invention is to provide a liquid ejecting head having a nozzle forming surface to which a nozzle section through which liquid is ejected is open, wherein an electrostatic propensity of the nozzle section due to contact with the liquid is lower than an electrostatic propensity of the nozzle forming surface due to contact with the liquid.

According to the above aspect of the present invention, it is possible to reduce electrostatic charging of the nozzle section, which is a portion that is particularly likely to be in contact with the liquid during liquid ejection, thereby reducing electrostatic charging of the liquid ejected. Accordingly, disadvantages due to electrostatic charging of the liquid, for example, attachment of the liquid onto the nozzle forming surface or the like due to the liquid repelling the ejection target which is electrostatically charged to an opposite polarity from the liquid, can be reduced.

In the above configuration, it is preferable that an amount of fluorine per unit area in the nozzle section is smaller than an amount of fluorine per unit area in the nozzle forming surface.

With this configuration, for the fluorine which tends to be electrostatically charged by contact with the liquid, the amount of fluorine per unit area in the nozzle section is smaller than the amount of fluorine per unit area in the nozzle forming surface. Accordingly, electrostatic charging of the liquid can be further reduced.

Further, in the above configuration, it is preferable that the nozzle section includes a first region on an upstream side and a second region on a downstream side in an ejection direction of the liquid, and the amount of fluorine per unit area decreases in an order of the nozzle forming surface, the second region, and the first region.

With this configuration, the amount of fluorine is smaller in the region which is more likely to be in contact with the liquid. Accordingly, electrostatic charging of the liquid can be further effectively reduced.

Further, in the above configuration, it is preferable that a second region is formed in the nozzle forming surface and the nozzle section is open to the second region.

With this configuration, since the second region is formed on the opening periphery of the nozzle section on the nozzle forming surface, the second region is less likely to be electrostatically charged even if the liquid attached on that portion is suctioned into the nozzle section. Accordingly, in this case as well, electrostatic charging of the liquid can be reduced.

Further, in the above configuration, it is preferable that a liquid repellent film containing fluorine is formed on the nozzle forming surface and the second region, and a thickness of the liquid repellent film in the second region is smaller than a thickness of the liquid repellent film on the nozzle forming surface.

With this configuration, the liquid repellent film containing fluorine is formed on the nozzle forming surface and the second region, and the thickness of the liquid repellent film in the second region is smaller than the thickness of the liquid repellent film on the nozzle forming surface. Accordingly, it is possible to ensure liquid repellent properties required from a viewpoint of wiping of the liquid attached on the second region of the nozzle section and reduction in electrostatic charging of the liquid.

Further, in the above configuration, it is possible that the nozzle forming surface is made of a silicon substrate or a metal material, the liquid repellent film containing fluorine is formed on the nozzle forming surface via a base film, the base film includes a thin region having a thickness smaller than that of other portions, and the nozzle section is open to the thin region.

With this configuration, since the thickness of the thin region is smaller than the thickness of the other portions of the base film, the liquid repellent film is located closer to the nozzle forming surface made of silicon or metal. Accordingly, even if the liquid repellent film is electrostatically charged, an electric charge can easily escape from the portion corresponding to the thin region toward the nozzle forming surface. As a result, electrostatic charging of the liquid ejected from the nozzle section can be reduced. Accordingly, this configuration achieves the liquid repellent properties required from a viewpoint of wiping of the liquid by a wiping member while reducing electrostatic charging of liquid.

According to another aspect of the present invention, a liquid ejecting apparatus includes the liquid ejecting head of any one of the above configurations.

With this configuration, since the liquid ejected from the nozzle section of the liquid ejecting head is less likely to be electrostatically charged, the liquid can be attached on the nozzle forming surface or other components of the liquid ejecting head.

In the above configuration, it is preferable that the liquid ejecting apparatus further includes a pressurizing unit that pressurizes a liquid supplying passage on an upstream side to the liquid ejecting head, wherein a cleaning process that discharges liquid from the nozzle section of the liquid ejecting head is performed by the pressurizing unit pressurizing the liquid supplying passage.

With this configuration, in the cleaning process (pressure cleaning process), the liquid is discharged from the nozzle section by means of pressure generated by the pressurizing unit located on the upstream side to the nozzle section in the liquid supplying passage. As a result, the pressure that acts on the liquid adjacent to the nozzle section is relatively gentle compared with the cleaning process (suctioning cleaning process) that suctions liquid from the nozzle sections by directly generating a negative pressure in the nozzle section. Accordingly, compared with the suctioning cleaning process, the momentum of liquid discharged from the nozzle section becomes gentle, thereby reducing the tendency of discharged liquid being attached onto the nozzle forming surface. Accordingly, electrostatic charging due to friction between the nozzle forming surface and the liquid is less likely to occur. As a result, electrostatic charging of liquid when the liquid is ejected from the nozzle section can be more effectively reduced.

In the above configuration, it is preferable that the liquid ejecting apparatus further includes a plurality of the liquid ejecting heads, each configured to eject liquid having different electric conductivity from the nozzle section, and a transportation mechanism that transports an ejection target of the liquid, wherein the liquid ejecting heads are arranged in descending order of electric conductivity of the liquid from upstream to downstream sides in the transport direction of the ejection target.

With this configuration, ejection of liquid is sequentially performed from the liquid ejecting head which accommodates the liquid having the highest electric conductivity. Accordingly, the ejection target becomes less likely to be electrostatically charged by the liquid ejected from the liquid ejecting head located on the upstream side, thereby reducing the possibility of the liquid (mist) being attached on the nozzle forming surface or the like of the liquid ejecting head due to the liquid ejected from the liquid ejecting heads located on more downstream side repelling the ejection target. Further, the liquid ejected from the liquid ejecting head is attached on the target position on the ejection target with high accuracy.

In the above configuration, it is preferable that the transportation mechanism includes a drum-shaped support that rotates while supporting the ejection target on an outer peripheral surface to thereby transport the ejection target.

With this configuration, it is possible to ensure a time for electrostatic discharge while the medium support rotates, even if the ejection target or the medium support is electrostatically charged by the electrostatic liquid ejected from the liquid ejecting head. Accordingly, it is possible to reduce disadvantages due to electrostatic charging.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, embodiments of the present invention will be described. Although the following embodiments which are described as preferred embodiments of the present invention include various limitations, the scope of the present invention is not construed to be limited to these embodiments unless otherwise specified in the following description. Further, in the following description, an ink jet recording apparatus (hereinafter, referred to as a printer) is described as an example of a liquid ejecting apparatus of the present invention.

Figure 1:
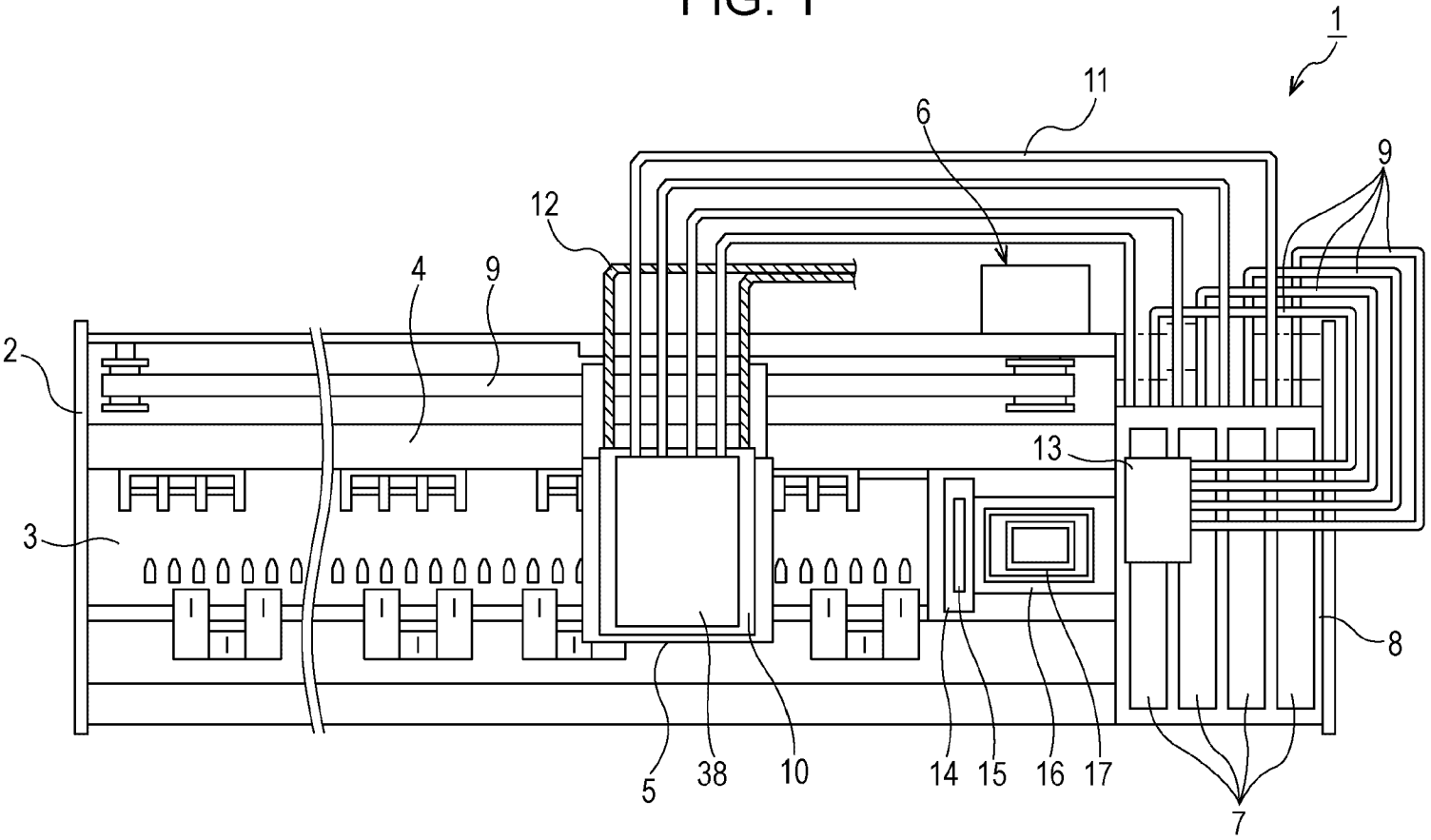
FIG. 1 is a plan view which illustrates a configuration of a liquid ejecting apparatus (printer).

FIG. 1 is a plan view which illustrates a configuration of a printer 1 on which a recording head 10, which is one type of a liquid ejecting head of the present invention, is mounted. The printer 1 includes a frame 2 and a platen 3 disposed in the frame 2 such that a recording medium such as a recording paper, cloth, or resin sheet (a type of liquid ejection target) is transported on the platen 3 by means of a sheet feeding roller which rotates by driving a sheet feeding motor (both are not shown in the figure). Moreover, a guide rod 4 is disposed in the frame 2 so as to extend in parallel to the platen 3. The guide rod 4 slidably supports a carriage 5 which houses the recording head 10. The carriage 5 is configured to move along the guide rod 4 by driving a carriage moving mechanism 6 in a main scan direction, which is perpendicular to a transport direction of the recording medium. The printer 1 ejects ink (a type of liquid according to the present invention) from nozzle sections 42 of the recording head 10 which will be described later, onto the recording medium, while moving the carriage 5 in the main scan direction relative to the recording medium loaded on the platen 3 to thereby form patterns such as characters and images (recording or printing).

A cartridge holder 8 on which ink cartridges 7 that store ink are detachably mounted is disposed on one side of the frame 2. In this embodiment, a total of four ink cartridges 7 are mounted on the cartridge holder 8. Ink may be of various known compositions, for example, water-based dye ink or pigment ink, organic solvent (eco-solvent) ink which is more weather-resistant than water-based ink, and light-curable ink which cures when exposed to ultraviolet light. The ink cartridges 7 of this embodiment are connected to an air pump 13 (a type of pressurizing unit of the present invention) via air tubes 9 such that air from the air pump 13 is supplied into the respective ink cartridges 7. Accordingly, when the ink cartridges 7 are pressurized by air, ink is supplied (pumped) toward the recording head 10 via ink supplying tubes 11. The ink supplying tubes 11 are, for example, flexible hollow members made of a synthesized resin such as silicone, and include ink flow passages corresponding to the respective ink cartridges 7. In this embodiment, flow passages of ink from the ink cartridges 7 to the nozzle sections 42 via the liquid flow passages in the recording head 10 through the ink supplying tubes 11 correspond to liquid supplying passages of the present invention. Further, a flexible flat cable (FFC) 12 is disposed between a main body of the printer 1 and the recording head 10 so as to transmit drive signals or the like from a controller (not shown in the figure) in the printer main body to the recording head 10.

A wiping mechanism 14 that wipes a nozzle forming surface 43*a* of a nozzle plate 43 of the recording head 10 mounted on the carriage 5 (a surface which faces the platen 3. See FIG. 4 and the like) is disposed at a home position, which is a non-recording region in the printer 1. The wiping mechanism 14 includes a wiper blade 15 (a type of a wiping member), and the wiper blade 15 is made of an elastic member such as rubber or elastomer. The wiping mechanism 14 positions the wiper blade 15 at a position where a distal end of the wiper blade 15 can be in contact with the nozzle forming surface 43*a* of the recording head 10 during wiping. As the recording head 10 passes, the distal end of the wiper blade 15 is in contact with the nozzle forming surface 43*a* so that the nozzle forming surface 43*a* is wiped off by the wiper blade 15 moving relative to the nozzle forming surface 43*a*.

A capping mechanism 16 is disposed adjacent to the wiping mechanism 14 at or near the home position. The capping mechanism 16 includes a tray-shaped cap 17 which can abut the nozzle forming surface 43*a* of the recording head 10. In the capping mechanism 16, a space in the cap 17 serves as a sealing space. The capping mechanism 16 can be in close contact with the nozzle forming surface 43*a* with the sealing space facing the nozzle section 42 of the recording head 10. Moreover, the capping mechanism 16 is connected to a pump unit (a type of suction unit), which is not shown in the figure, such that negative pressure can occur in the sealing space by actuating the pump unit. When the pump unit is actuated while the capping mechanism 16 is in close contact with the nozzle forming surface 43*a* to generate negative pressure in the sealing space (closed space), the ink and air bubbles in the recording head 10 are suctioned through the nozzle sections 42 and discharged into the sealing space in the cap 17. In addition, the printer 1 of the present embodiment can pressurize the ink supply passage located on the upstream side of the recording head 10 (close to the ink cartridges 7), for example, by using the air pump 13 to perform a pressure cleaning process for recovering ejection ability of the nozzle section 42 by pressurizing a flow passage in the recording head 10 to thereby discharge thickened ink from the nozzle sections 42. The pressure cleaning process will be described later.

Figure 2:
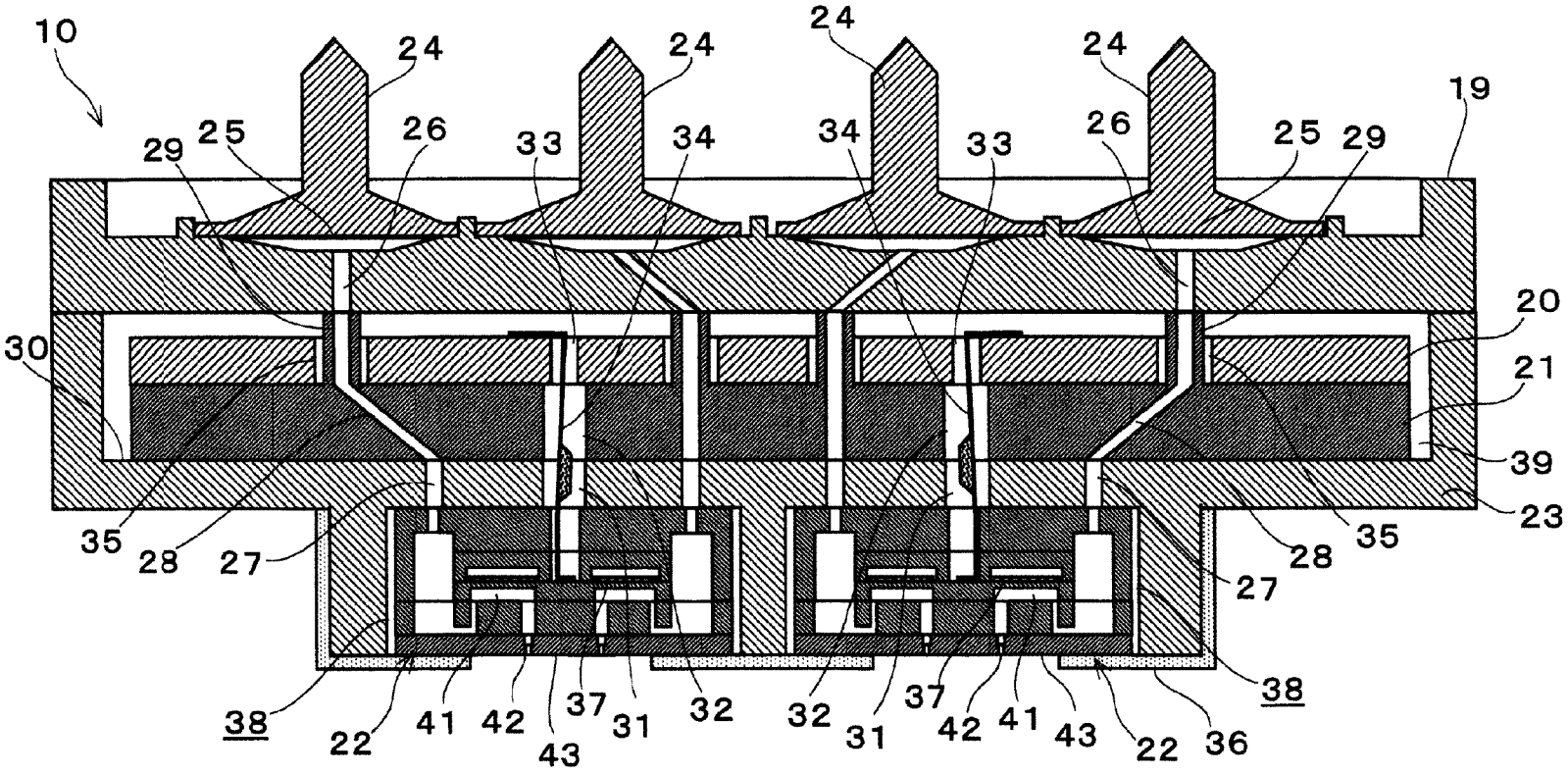
FIG. 2 is a cross sectional view of a liquid ejecting head (recording head).
Figure 3:
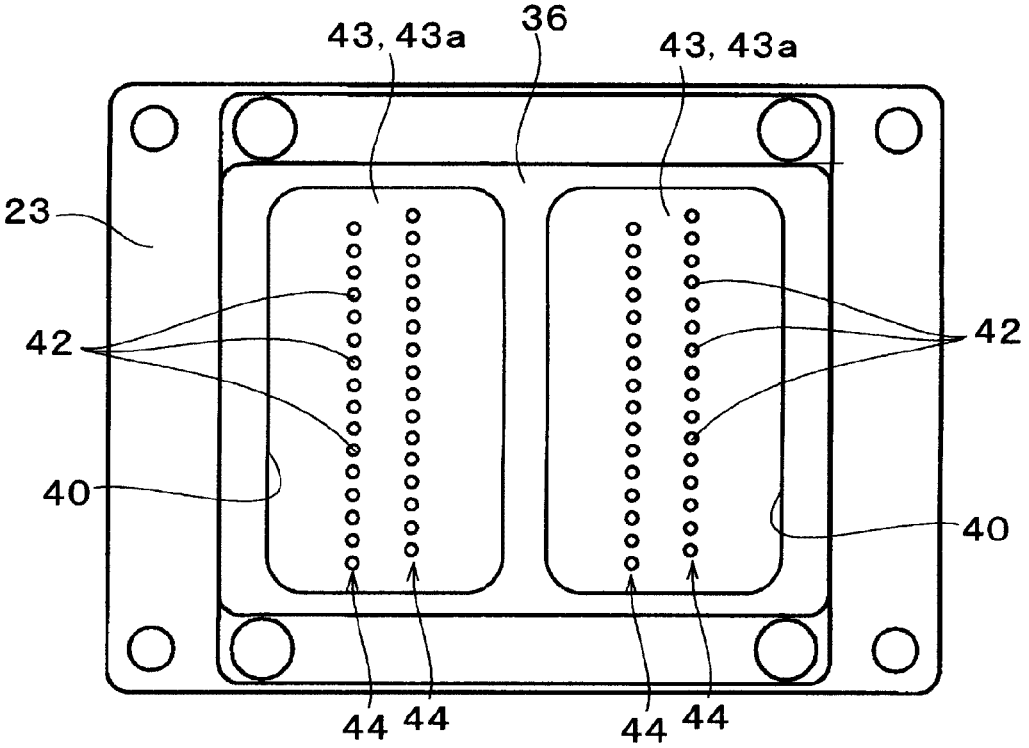
FIG. 3 is a bottom view of the liquid ejecting head.

FIG. 2 is a cross sectional view of the recording head 10 of the present embodiment, and FIG. 3 is a bottom view of the recording head 10. The recording head 10 of the present embodiment includes an ink introduction member 19, a relay substrate 20, an intermediate flow passage member 21, head units 22, a holder 23 and the like, which are stacked. For convenience of description, the stacking direction of the components are hereinafter referred to as an up and down direction.

A plurality of ink introduction needles 24 are disposed on the top surface of the ink introduction member 19 with filters 25 interposed therebetween. Each ink introduction needle 24 is provided for each ink type (color). Both the ink introduction member 19 and the ink introduction needle 24 are made of a synthetic resin. In addition, the filter 25 is a member that filters ink introduced from the ink introduction needle 24 and catches foreign substances and air bubbles in the ink. In this embodiment, the ink cartridges 7 are mounted on the top surface of the ink introduction member 19 so that the ink introduction needles 24 are inserted into the ink cartridges 7. Then, ink in the ink cartridges 7 is introduced into an inner flow passage via an opening, which is not shown in the figure, provided on the tip of the ink introduction needles 24. As ink is introduced from the ink introduction needles 24, ink flows in the supply flow passages 26 via the filters 25, and is supplied to the intermediate flow passage member 21 disposed under the ink introduction member 19 via the flow passage connecting section 29. In the ink introduction member 19 of this embodiment, the needle-shaped ink introduction needles 24 are inserted into the ink cartridges 7 to introduce ink. However, the configuration is not limited thereto. For example, a so-called foam type configuration can also be employed, in which a porous member such as a non-woven cloth or sponge is disposed at an ink inlet portion of the ink introduction member 19 and a similar porous member is disposed at an ink outlet portion of an ink storing member such as an ink cartridge or a sub-tank so that both porous members are in contact with each other to allow for a flow of ink due to a capillary action.

The intermediate flow passage member 21 is a substrate having intermediate flow passages 28 that guides ink introduced from the ink introduction needles 24 toward the head units 22. On the top surface of the intermediate flow passage member 21, the flow passage connecting sections 29 formed in a cylindrical shape are disposed to protrude around a periphery of the inlet opening of the intermediate flow passage. The flow passage connecting section 29 has a height (a length protruding from the top surface of the intermediate flow passage member 21) which is larger than a thickness of the relay substrate 20 disposed between the ink introduction member 19 and the intermediate flow passage member 21. The flow passage connecting section 29 communicates with the supply flow passage 26 of the ink introduction member 19 so as to allow ink from the ink introduction member 19 to be introduced into the intermediate flow passage 28. The intermediate flow passage 28 is open to the lower surface of the intermediate flow passage member 21 so as to communicate with a communication flow passage 27 formed on a partition 30 of the holder 23. Further, wiring openings 32 are formed in the intermediate flow passage member 21 to penetrate in a thickness direction at positions spaced from the intermediate flow passages 28. The wiring opening 32 is a void that communicates with a wiring insertion port 33 of the relay substrate 20, which will be described later, and communicates with a wiring penetrating port 31 formed on the partition 30 of the holder 23 so that a flexible substrate 34, which will be described later, is inserted therein.

The relay substrate 20, which is disposed between the ink introduction member 19 and the intermediate flow passage member 21, is a printed substrate having a wiring pattern or the like for receiving a drive signal, ejection data (raster data) or the like from the printer main body via the FFC 12 and supplying the drive signal to piezoelectric elements 37 in the head units 22 via the flexible substrate 34. The top surface of the relay substrate 20 (the surface opposite from the lower surface of the head unit 22) is provided with the substrate terminals connected to the flexible substrates 34. Further, a connector which is connected to the FFC 12 from the printer main body and other electronics are also mounted on the relay substrate 20 (not shown in the figure).

In the relay substrate 20, clearance holes 35 are formed at positions corresponding to the flow passage connecting section 29 of the intermediate flow passage member 21 so that the flow passage connecting sections 29 are inserted. The clearance hole 35 is a penetrating hole having a diameter slightly larger than the outer diameter of the flow passage connecting section 29. Moreover, wiring insertion ports 33 that penetrate the substrate thickness direction are formed on the relay substrate 20 at positions adjacent to the substrate terminals 34 in the arrangement direction of the substrate terminals 34. The wiring insertion port 33 is a hole through which the other end of the flexible substrate 34 is inserted, while one end of the flexible substrate 34 is connected to the element terminal of the piezoelectric element 37. In this embodiment, the wiring insertion port 33 has inner dimensions in the longitudinal direction and lateral direction to such an extent that allows the flexible substrate 34 to be smoothly inserted.

A plurality of housing cavities 38 which are spaces that can house the head units 22 are partitioned in the holder 23. The housing cavity 38 is open to the lower surface (a surface that faces the recording medium in the printer 1 during a printing operation) such that the head unit 22 connected to a fixation plate 36 is housed through the opening. The fixation plate 36 is, for example, made up of a metal plate member such as a stainless steel. As shown in FIG. 3, the fixation plate 36 has an opening 40 so as to expose a region in which the nozzle sections 42 of the nozzle plate 43 are formed in each head unit 22. When a bottom surface of each head unit 22 is joined to the fixation plate 36, the height direction of the head unit 22 (positions in a direction vertical to the nozzle plate 43) is defined, and the nozzle sections 42 on the nozzle plate 43 are exposed through the opening 40.

In an upper part of the holder 23 with respect to the housing cavity 38, a substrate mounting portion 39 is provided, on which the intermediate flow passage member 21 and the relay substrate 20 are disposed. The substrate placing portion 39 and the housing cavity 38 are separated by the partition 30, and the intermediate flow passage member 21 is disposed on the upper surface of the partition 30. The communication flow passages 27 and the wiring penetrating ports 31 are formed in the partition 30 so as to penetrate in a thickness direction. When the head units 22 are positioned and housed in the housing cavities 38, the ink flow passages including the nozzle sections 42 and the pressure chambers 41 of the head units 22 communicate with the communication flow passages 27. Accordingly, ink introduced from the ink cartridge 13 through the ink introduction needle 24 is filtered by the filter 25, and then fills the ink flow passage (a type of liquid flow passage) via the supply flow passage 26, the intermediate flow passage 28, and the communication flow passage 27 to the nozzle sections 42 of the head unit 22.

The head unit 22 of the present embodiment includes a nozzle plate 43 on which the nozzle sections 42 are formed, a pressure chamber 41 that communicates the nozzle sections 42, piezoelectric element 37 which serves as a drive element that causes pressure change in ink in the pressure chamber 41. The nozzle plate 43 is a plate member on which a plurality of nozzle sections 42 are formed in array. In this embodiment, the plurality of nozzle sections 42 are arranged at a predetermined pitch so as to form a nozzle row. The pressure chamber 41 and the piezoelectric element 37 are each formed for the nozzle sections 42. An electrode terminal of the piezoelectric element 37, which is not shown in the figure, is connected to one end terminal of the flexible substrate 34, and the other end terminal of the flexible substrate 34 is connected to the relay substrate 20. When a drive signal (drive voltage) is applied to the piezoelectric element 37 via the relay substrate 20 and the flexible substrate 34, a piezoelectric active portion of the piezoelectric element 37 flexibly deforms in response to change in applied voltage and thus causes a flexible surface that forms one surface of the pressure chamber 41 to move in a direction toward the nozzle sections 42 or away from the nozzle sections 42. Accordingly, ink in the pressure chamber 41 is subject to pressure change so that ink is ejected from the nozzle sections 42 by using this pressure change. In addition, a configuration of the recording head 10 is not limited to the example described above. For example, recording heads (liquid ejecting heads) having various configurations such as those using other actuators such as a heat generating element and electrostatic actuator as an actuator that ejects ink can be used.

Next, the nozzle plate 43 will be described in detail. The nozzle plate 43 is a member on which a plurality of nozzle sections 42 are formed at a predetermined pitch in array. A material for the nozzle plate 43 is a silicon substrate or a metal plate such as a stainless steel. In this embodiment, a nozzle row 44 is made up of the plurality of nozzle sections 42 which are arranged in a direction corresponding to the transport direction of the recording medium. On the nozzle plate 43 of each head unit 22, two arrays of the nozzle rows 44 are formed. Further, a surface of the nozzle plate 43 which ejects ink and faces the recording medium on the platen 3 corresponds to the nozzle forming surface of the recording head 10. An ejection side of the nozzle sections 42 (downstream side in the ejection direction) is open to the nozzle forming surface 43*a*. Further, the nozzle section 42 refers to a through hole formed on the nozzle plate 43. In a configuration which includes a liquid repellent film 47 and a base film 48 on the nozzle forming surface as described below, holes which penetrate through these films are collectively referred to as the nozzle section 42. In other words, the nozzle section 42 is an area extending from the opening of the through hole formed on the nozzle forming surface 43*a* of the nozzle plate 43 having the liquid repellent film 47 and the base film 48 to the opening of the through hole formed on the opposite surface (which faces the pressure chamber 41).

Figure 4:
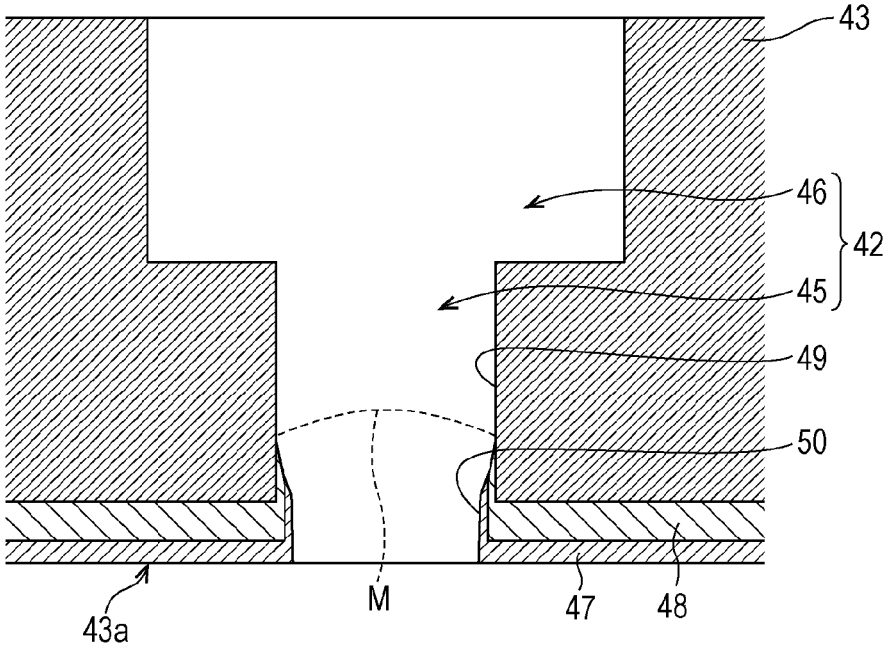
FIG. 4 is a cross sectional view of an area including a nozzle section.
Figure 5:
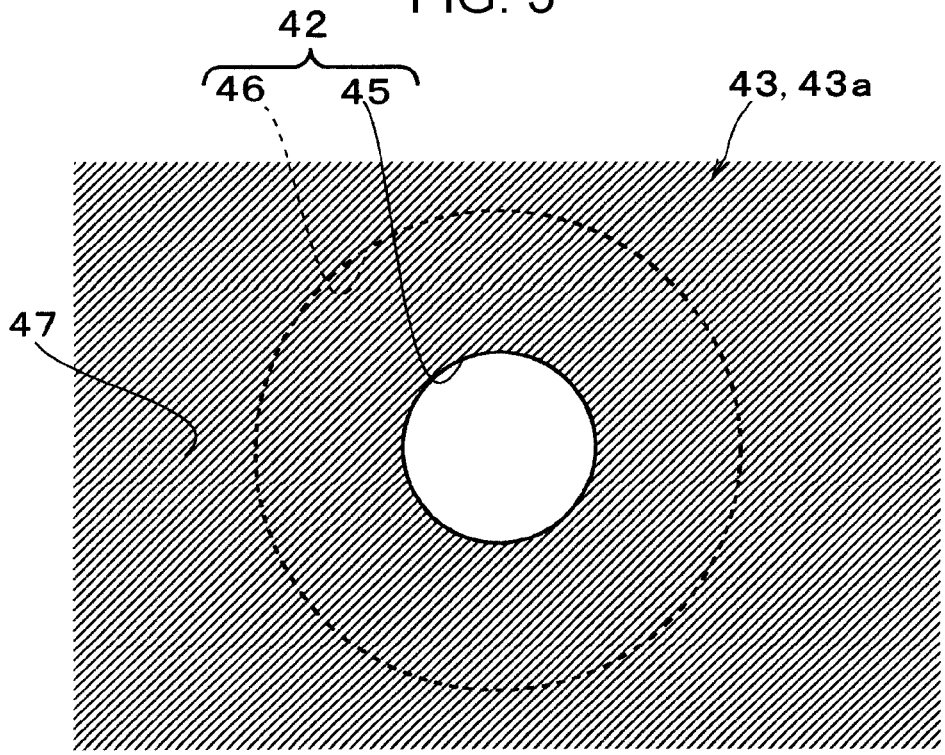
FIG. 5 is a plan view of an area including the nozzle section.

FIG. 4 is a cross sectional view of the nozzle section 42 in a center axis direction (ink ejection direction), and FIG. 5 is a plan view of an opening portion of the nozzle section 42 on the nozzle forming surface 43*a* of the nozzle plate 43. In FIG. 4, the upper side is an upstream side (close to the pressure chamber 41) in the ink ejection direction, and a lower side is a downstream side (close to the platen 3) in the ink ejection direction. Further, a hatched portion in FIG. 5 shows the liquid repellent film 47. The nozzle section 42 of this embodiment is formed in a two-stage cylinder made up of a first nozzle section 45 on the downstream side and a second nozzle section 46 on the upstream side with a flow passage cross sectional area of the first nozzle section 45 being smaller than a flow passage cross sectional area of the second nozzle section 46. Both the first nozzle section 45 and the second nozzle section 46 are formed in a true circle in a plan view. Ink is ejected from the opening on the surface opposite from the second nozzle section 46 of the first nozzle section 45. Here, the true circle refers not only to an exact circle but also to a slightly imperfect circle. In other words, any circle may be included as long as it is generally recognized as a substantially true circle by visual observation. In addition, a tapered shape having an inner wall surface which is inclined so that an inner diameter of the second nozzle section 46 increases from the downstream side (close to the first nozzle section 45) to the upstream side (close to the pressure chamber 41) may also be included.

The liquid repellent film 47 is formed on the nozzle forming surface 43*a* of the nozzle plate 43 via the base film 48. The base film 48 is provided between the nozzle plate 43 and the liquid repellent film 47 to connect them. Further, the liquid repellent film 47 is formed by coating a liquid repellent agent (silane coupling agent) which contains fluorine. The liquid repellent agent includes silane compound containing a fluoroalkyl group, for example, trifluoropropyl trimethoxy silane. Moreover, the liquid repellent film 47 may be formed not only by coating, but also by vapor deposition, spin coating or the like. In this embodiment, as shown in FIG. 4, the liquid repellent film 47 is also formed on an inner peripheral surface of the nozzle section 42, more specifically, on part of an inner peripheral surface of the first nozzle section 45. In the nozzle section 42, a region in which the liquid repellent film 47 is not formed is a first region 49 (including a region of the first nozzle section 45 in which the liquid repellent film is not formed and a region of the second nozzle section 46 in which the liquid repellent film is not formed), and a region in which the liquid repellent film 47 is formed is a second region 50. A thickness of the liquid repellent film 47 in the second region 50 is smaller than a thickness of the liquid repellent film 47 on the nozzle forming surface 43*a* of the nozzle plate 43. Accordingly, the content of fluorine per unit area in the second region 50 is smaller than that on the nozzle forming surface 43*a*. In other words, the content of fluorine per unit area decreases in the order of the nozzle forming surface 43*a*, the second region 50, and the first region 49. That is, the amount of fluorine is smaller in the region that is more likely to be in contact with ink.

Here, in the triboelectric series, the liquid repellent film 47 which contains fluorine is in the more negative position than ink. Moreover, a difference between the position of the liquid repellent film 47 and the position of the ink in the triboelectric series is greater than a difference between the position of the base film 48 and the position of the ink or a difference between the position of the material of the nozzle plate 43 (silicon or metal) and the position of the ink. Accordingly, the liquid repellent film 47 is more likely to be negatively charged by contact or friction with ink compared with other materials. Therefore, in comparison between the nozzle forming surface 43*a* and the second region 50 of the nozzle section 42, the second region 50 which has smaller amount of fluorine per unit area is less likely to be electrostatically charged by contact or friction with ink. By using the above configuration, in this embodiment, electrostatic charging is less likely to occur on the nozzle forming surface 43*a*, the second region 50, and the first region 49 in this order. That is, the electrostatic propensity due to contact with ink decrease in the order of the nozzle forming surface 43*a*, the second region 50, and the first region 49.

The nozzle plate 43 of the present embodiment is produced in the following procedures. First, plasma polymerization of a silicone material is performed on the substrate surface of the nozzle plate 43 on which the nozzle sections 42 are formed to thereby form a plasma polymerized film, which in turn is oxidized to form the base film 48. Here, the base film 48 is formed on the entire substrate surface of the nozzle plate 43 and on the inner peripheral surface of the nozzle section 42. The base film 48 is not limited to a single layer, but may be a multilayered structure. Subsequently, the entire substrate of the nozzle plate 43 is immersed in metal alkoxide solution which is made, for example, by mixing silane coupling agent which contains a fluoroalkyl group with a solvent to thereby form a molecular film having polymerized metal alkoxide on the base film 48. Then, subsequent to dry process, anneal process, and the like, the liquid repellent film 47 is formed on the entire substrate surface of the nozzle plate 43 and on the inner peripheral surface of the nozzle section 42. Since the liquid repellent film 47 is mainly required for the nozzle forming surface 43*a*, an excess liquid repellent film 47 is removed. Specifically, for example, plasma treatment is applied on the surface of the nozzle plate 43 opposite from the nozzle forming surface 43*a* (the surface close to the pressure chamber 41) to remove the liquid repellent film 47 except for the nozzle forming surface 43*a* and the second region 50. In this step, since the liquid repellent film 47 in the second region 50 is partially removed, the thickness of the liquid repellent film 47 in the second region 50 becomes smaller than the thickness of the liquid repellent film 47 in the nozzle forming surface 43*a*. Accordingly, the amount of fluorine per unit area in the second region 50 becomes smaller than the amount of fluorine per unit area in the nozzle forming surface 43*a*. In a configuration described in this embodiment, the base film 48 is also removed in a portion except for the nozzle forming surface 43*a* and the second region 50. However, the invention is not limited to this configuration, and only the liquid repellent film 47 can be removed while remaining the base film 48.

As described above, the content of fluorine, which has a tendency of being electrostatically charged due to contact with ink, is smaller in the nozzle section 42 of the present embodiment than in the nozzle forming surface 43*a*. Accordingly, the nozzle section 42 is less likely to be electrostatically charged when being in contact with ink. As a result, when ink is ejected from the nozzle sections 42, electrostatic charging of ink to positive polarity due to electrostatic induction is reduced. Accordingly, for example, even in the configuration in which recording (ink ejection operation) is performed on a positively charged recording medium, it can be reduced that ink mist is attached on the nozzle forming surface 43*a* or other components in the printer 1 due to repelling of the recording medium and the ink. In particular, this is effective in the configuration which ejects ink having electric conductivity of $1.0\times10^{-2}$ [S/m] or less (that is, ink which is less likely to be electrostatically discharged when it is electrostatically charged). In this embodiment, since the amount of fluorine is smaller in a region which is more likely to be in contact with ink, the electrostatic charging of ink ejected from the nozzle sections 42 can be further effectively reduced. Further, since the nozzle section 42 includes the second region 50 in which the liquid repellent film 47 is formed, liquid repellent properties required for a wiping member to wipe off the ink attached on the opening periphery of the nozzle section 42 can be provided. Accordingly, it is possible to ensure liquid repellent properties required for wiping of the ink attached on the second region 50 of the nozzle section 42 and reduction in electrostatic charging of ink.

Moreover, as shown in FIG. 4, it is desirable that ink is ejected in a state in which a meniscus M, which is an ink surface at the nozzle section 42, is located in the first region 49 of the first nozzle section 45 (located in the first nozzle section 45 while being drawn toward the pressure chamber 41 beyond the second region 50 to the extent that does not cross a border between the first nozzle section 45 and the second nozzle section 46) when ink is ejected from the nozzle section 42. That is, for example, ink can be ejected from the nozzle section 42 in the state in which the meniscus M is located in the first region 49, for example, by driving the piezoelectric elements 37 to further increase the voltage of the pulse element that expands the pressure chamber 41 or to steeply change the potential of the pulse element, or, after the pulse element, to further accelerating an occurrence timing of the pulse element that contracts the pressure chamber 41. Thus, the ink ejected from the nozzle section 42 becomes less likely to be in contact with the liquid repellent film 47, thereby ensuring reduction in electrostatic charging of the ink.

Figure 6:
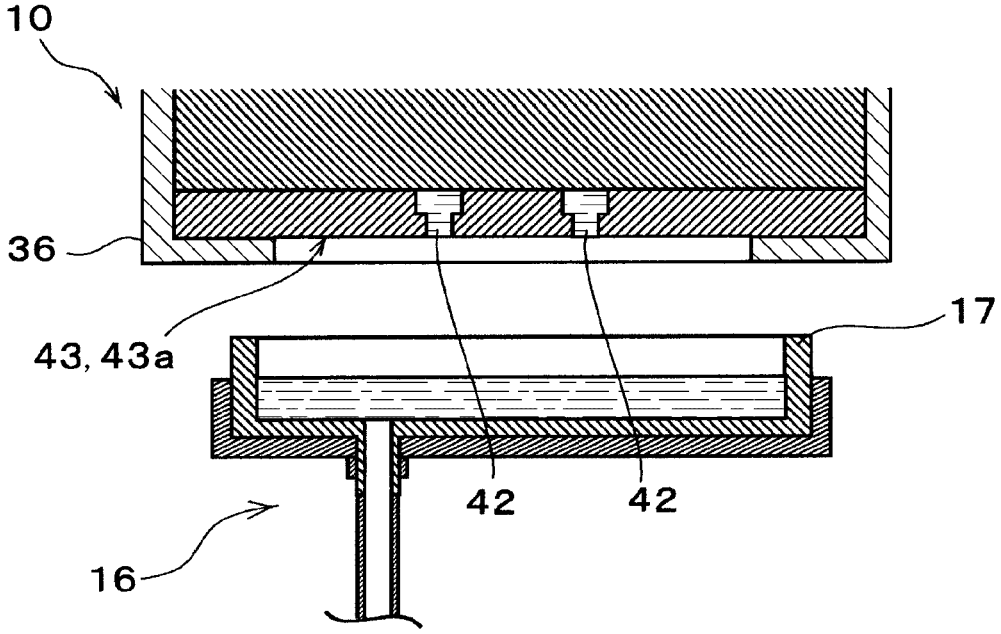
FIG. 6 is a schematic view which illustrates a pressure cleaning process.

FIG. 6 is a schematic view which illustrates a pressure cleaning process. In the printer 1 having the above configuration, a pressure cleaning process is adapted as a cleaning process for removing thickened ink or air bubbles in the ink flow passage in the recording head 10. As shown in FIG. 6, the pressure cleaning process is performed while the cap 17 faces the nozzle forming surface 43*a* of the recording head 10 in a non-contact manner (spaced from the nozzle forming surface 43*a*). In this state, the liquid flow passage in the recording head 10 is pressurized by the air pump 13 located on the upstream side of the recording head 10 in the ink supply passage to thereby discharge ink from the nozzle sections 42 to the cap 17. In the pressure cleaning process, since ink is discharged from the nozzle section 42 by means of pressure generated by a pressurizing unit (air pump 13) located on the upstream side of the nozzle section 42 in the liquid supplying passage, the pressure acts on the ink adjacent to the nozzle section 42 is relatively gentle compared with a suctioning cleaning process that suctions ink from the nozzle sections 42 by directly generating a negative pressure in the nozzle section 42. Accordingly, compared with the suctioning cleaning process, the momentum of ink discharged from the nozzle section 42 in the pressure cleaning process becomes gentle, thereby reducing the tendency of ink being attached on the nozzle forming surface 43*a*. Further, in the pressure cleaning process, ink is discharged from the nozzle section 42 while the cap 17 is not in close contact with the nozzle forming surface 43*a*. From this point, ink discharged from the nozzle section 42 is also less likely to be attached on the nozzle forming surface 43*a* compared with the suctioning cleaning process. Accordingly, electrostatic charging due to friction between the nozzle forming surface 43*a* and ink is less likely to occur. As a result, electrostatic charging of ink during ink ejection from the nozzle section 42 can be more effectively reduced. Moreover, it is possible to start printing process immediately after the cleaning process, thereby reducing the turnaround time of the overall process performed by the printer 1.

Similarly, in an initial filling operation in which ink in the ink cartridge 7 is filled in the inner flow passage of the recording head 10, ink is fed into the recording head 10 by means of pressure generated by the air pump 13. Accordingly, compared with a technique of filling ink by suctioning while the cap 17 is in close contact with the nozzle forming surface 43*a*, ink discharged from the nozzle section 42 during the filling operation is less likely to be attached on the nozzle forming surface. As a result, electrostatic charging due to friction between the nozzle forming surface 43*a* and ink can be reduced.

Figure 7:
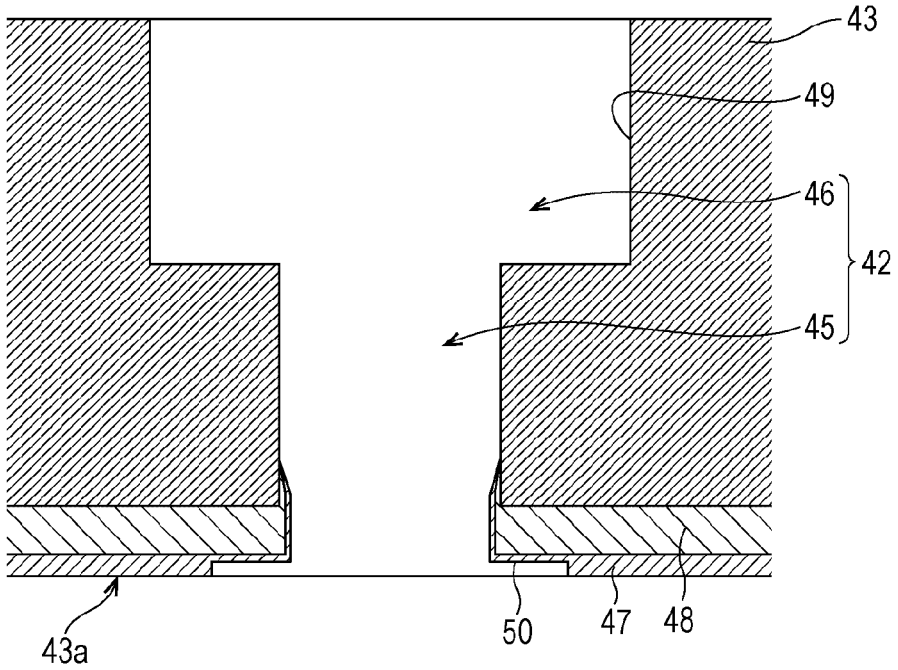
FIG. 7 is a cross sectional view which illustrates a configuration of the nozzle section in a second embodiment.
Figure 8:
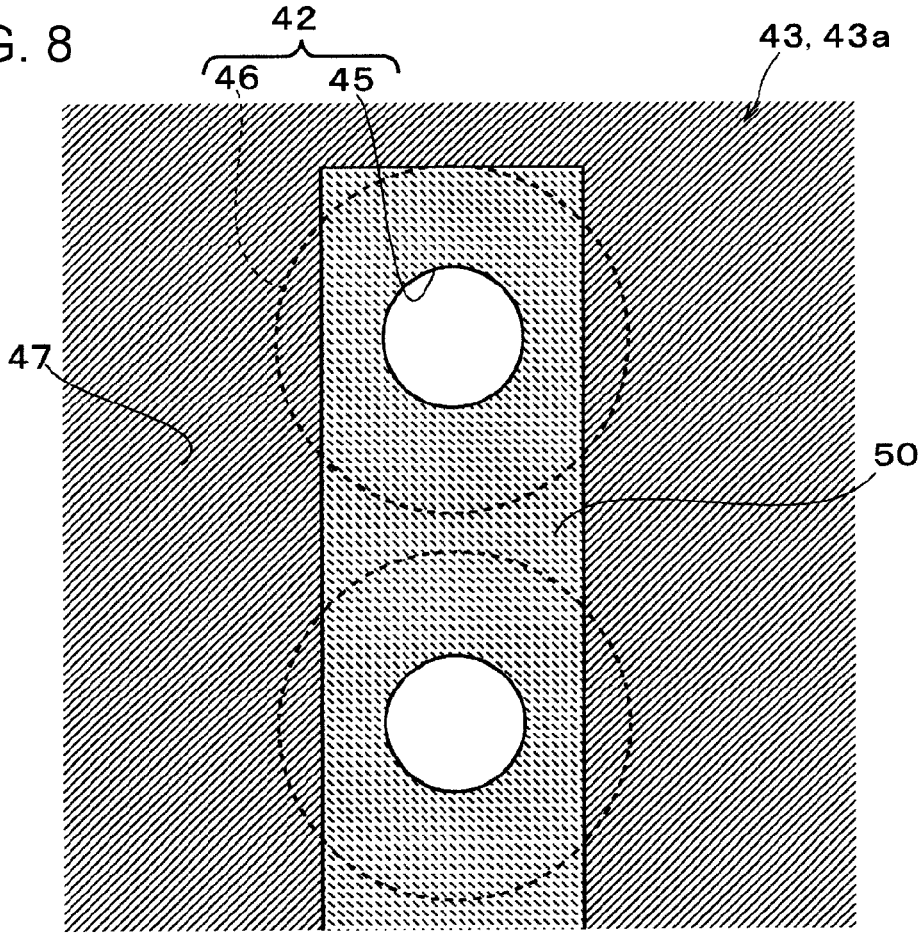
FIG. 8 is a plan view of an area including the nozzle section in the second embodiment.

Next, other embodiments of the present invention will be described. FIGS. 7 and 8 are views which illustrate peripheral configurations of the nozzle section 42 in the second embodiment. FIG. 7 is a sectional view, and a FIG. 8 is a plan view. While a configuration in the above embodiment has been described as the second region 50 being formed only in the nozzle section 42, the invention is not limited thereto. The present embodiment differs from the first embodiment in that the second region 50 is formed from the inside (inner peripheral surface) of the nozzle section 42 to the opening periphery of the nozzle section 42 on the nozzle forming surface 43*a*. That is, the second region 50 is continuously formed from the inside (inner peripheral surface) of the nozzle section 42 to the opening periphery of the nozzle section 42 on the nozzle forming surface 43*a* (part of the second region 50 is also formed on the outside of the nozzle section 42). In this embodiment, plasma treatment is applied on the nozzle forming surface 43*a* via a mask on which openings are formed at positions corresponding to the regions of the plurality of nozzle sections 42 (nozzle rows) so that the liquid repellent film 47 exposed to the openings is removed or reduced in thickness. As a result, the second region 50 having a small amount of fluorine compared to the other portions on the nozzle forming surface 43*a* is also formed on the nozzle forming surface 43*a*. The nozzle sections 42 are open to the second region 50 on the nozzle forming surface 43*a*. In addition, in the example of FIG. 8, the second region 50 on the nozzle forming surface 43*a* is formed in common for the plurality of nozzle sections 42. However, the second regions 50 may be independently formed for each of the nozzle sections 42. As described above, since the second region 50 is formed on the opening periphery of the nozzle section 42 on the nozzle forming surface 43*a*, the second region 50 is less likely to be electrostatically charged when the ink attached on that portion is suctioned into the nozzle section 42. As a result, in this case as well, electrostatic charging of ink can be reduced. Further, a configuration is also possible in which the second region 50 is not present on the inner peripheral surface of the nozzle section 42 and present only on the opening periphery of the nozzle section 42 on the nozzle forming surface 43*a*.

Figure 9:
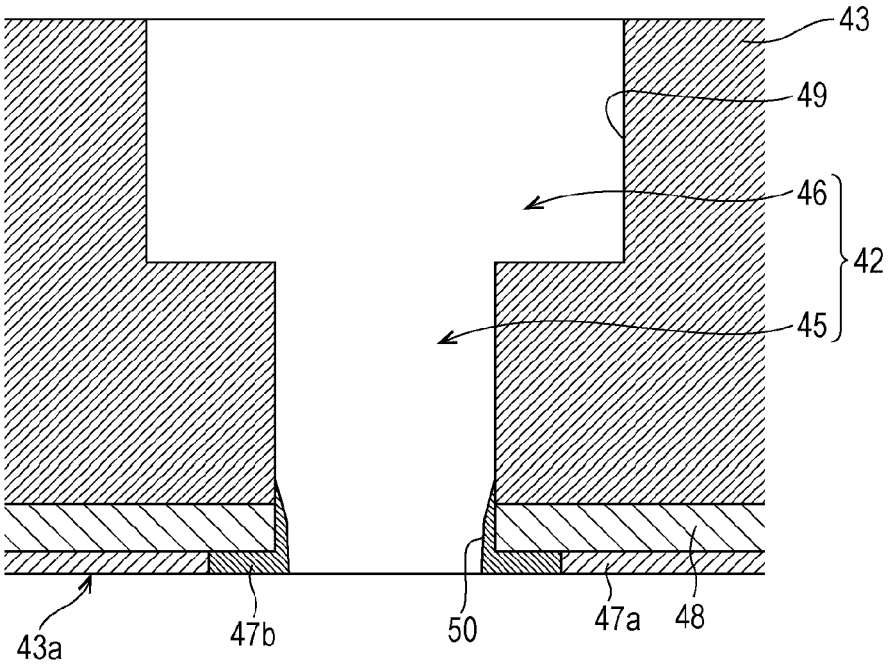
FIG. 9 is a cross sectional view which illustrates a configuration of the nozzle section in a third embodiment.

FIG. 9 is a cross sectional view of the nozzle section 42 in a third embodiment. In the first embodiment and the second embodiment, the thickness of the liquid repellent film 47 in the second region 50 is reduced to be smaller than the thickness of the liquid repellent film 47 in the nozzle forming surface 43*a*, thereby reducing the amount of fluorine per unit area. However, the invention is not limited to this configuration. For example, a second liquid repellent film 47*b* which has the content (wt. %) of fluorine different from that in the first liquid repellent film 47*a* on the nozzle forming surface 43*a* can be separately formed in the second region 50 at the nozzle section 42 and the opening periphery of the nozzle section 42. The second liquid repellent film 47*b* in the third embodiment shown in FIG. 9 is a liquid repellent film formed separately from the first liquid repellent film 47*a* on the nozzle forming surface 43*a*. The second liquid repellent film 47*b* may be formed of liquid repellent agent used for the first liquid repellent film 47*a* and containing a reduced amount of fluorine, or liquid repellent agent containing no fluorine. In the latter case, a material having a difference between the position of the ink and the position of the material in the triboelectric series smaller than a difference between the position of ink ejected from the nozzle section 42 and the position of the fluorine, for example, an organic compound which contains silicone, in particular, an organic compound which contains an alkyl siloxane group can be used. Further, the liquid repellent film 47 which is not an insulating material by itself and which exhibits conductive properties can also be used. In this case, the liquid repellent film 47 is preferably grounded. Moreover, the liquid repellent film 47 may be formed not only by coating, but also by applying surface treatment or the like on the second region 50 to provide liquid repellent properties. For example, the surface of the second region 50 can be roughened by plasma treatment, CVD method or the like to provide liquid repellent properties on the second region 50. This configuration also achieves the required liquid repellent properties while reducing electrostatic charging of ink ejected from the nozzle section 42, similarly to the first embodiment.

Figure 10:
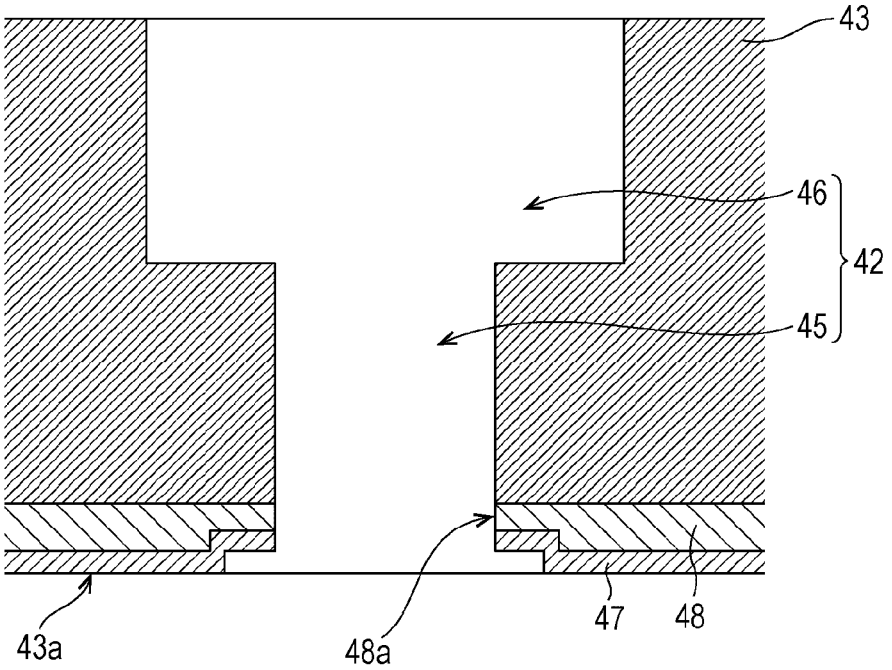
FIG. 10 is a cross sectional view which illustrates a configuration of the nozzle section in a fourth embodiment.

FIG. 10 is a cross sectional view of the nozzle section 42 in a fourth embodiment. The present embodiment differs from the above embodiments in that the thickness of the base film 48 on the opening periphery of the nozzle section 42 on the nozzle forming surface 43*a* is smaller than the thickness of the base film 48 of the other portions on the nozzle forming surface 43*a*. That is, the base film 48 includes a thin region 48*a* having a reduced thickness, and the nozzle section 42 is open to the thin region 48*a*. In addition, the thickness of the liquid repellent film 47 in the thin region 48*a* can be the same as the thickness of the liquid repellent film 47 in the other portions of the base film 48, but is preferably smaller than the thickness of the liquid repellent film 47 in the other portions of the base film 48. In this configuration, since the thickness of the thin region 48*a* is smaller than the thickness of the other portions of the base film 48, the liquid repellent film 47 is located closer to the nozzle forming surface 43*a* of the nozzle plate 43 made of silicon or metal. Accordingly, even if the liquid repellent film 47 is electrostatically charged, an electric charge can easily escape from the portion corresponding to the thin region 48*a* toward the nozzle plate 43. Further, a line of electric force from the electrostatically charged liquid repellent film 47 is easily shielded by the nozzle plate 43 made of silicon or metal. As a result, electrostatic charging of ink ejected from the nozzle section 42 can be reduced. Accordingly, this configuration also achieves the liquid repellent properties required from a viewpoint of wiping of ink by a wiping member while reducing electrostatic charging of ink, similarly to the above embodiments.

Figure 11:
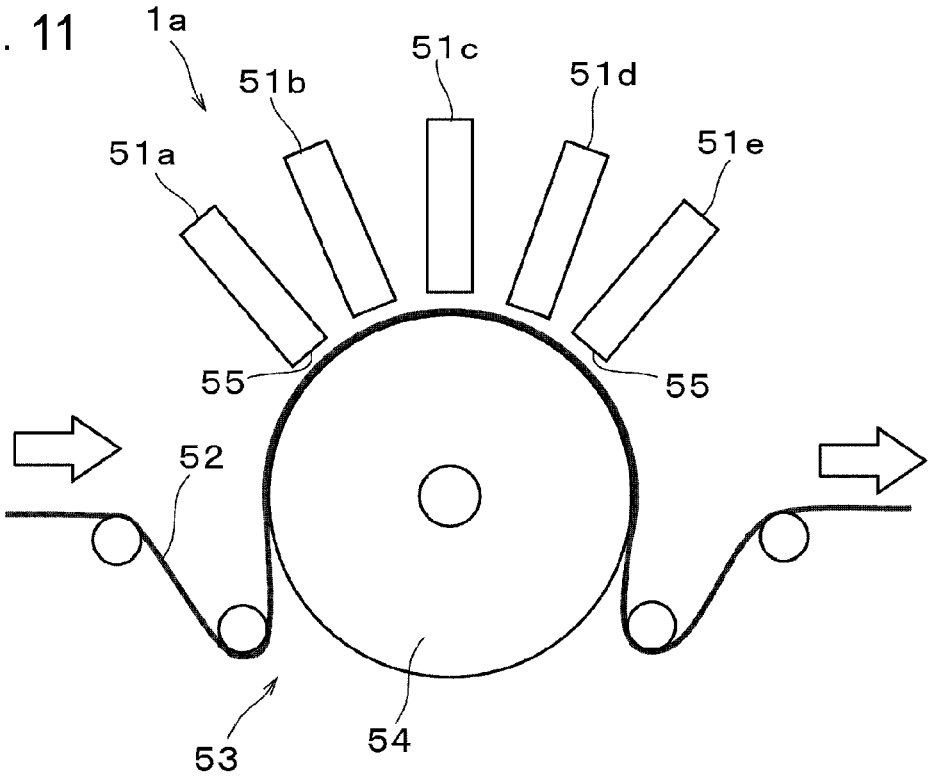
FIG. 11 is a schematic view which illustrates a configuration of the liquid ejecting apparatus in a fifth embodiment.

FIG. 11 is a schematic view which illustrates a configuration of a printer 1*a* in a fifth embodiment. Although the first embodiment has been described by illustrating a so-called serial type printer 1, which performs ejection of ink while moving the recording head 10 relative to the width direction of the recording medium, the invention is not limited thereto. For example, the present invention can be applied to a so-called line-type printer, in which the entire length of the nozzle row is set to be the length which can accommodate for the width of the recording medium of a maximum size that can be printed in the printer, and a recording operation is performed while transporting a recording medium without performing movement (scanning) of the recording head. The printer 1*a* in the fifth embodiment shown in FIG. 11 includes a total of five recording heads 51*a* to 51*e*, each having different electric conductivities of ink ejected from the nozzle section. That is, the recording heads 51*a* to 51*e* are each configured to eject ink of different types. Further, in the present embodiment, a recording medium 52 is a continuous sheet such as a roll paper. Moreover, a transportation mechanism 53 that transports the recording medium 52 includes a drum-shaped medium support 54 (a type of a support in the present invention), and is configured to transport the recording medium 52 by rotating the medium support 54 while the recording medium 52 is supported on the outer peripheral surface of the medium support 54.

The recording heads 51*a* to 51*e* are arranged in descending order of electric conductivity of ink from upstream to downstream sides in the transport direction of the recording medium 52 along the outer peripheral surface of the medium support 54 with each nozzle forming surface facing the outer peripheral surface of the medium support 54. In particular, the fifth recording head 51*e* located on the most downstream side is a recording head that ejects, for example, a solvent ink having a solvent of an organic solvent (a non-water base) as an ink with the lowest electric conductivity. In the present embodiment, ejection of ink is sequentially performed from the recording head 51 which accommodates ink having the highest electric conductivity. Accordingly, the recording medium 52 and the medium support 54 become less likely to be electrostatically charged by the ink ejected from the recording head 51 located on more upstream side, thereby reducing the possibility of ink (mist) being attached on the nozzle forming surface or the like of the recording head 51 due to the ink ejected from the recording heads 51 located on more downstream side repelling the recording medium 52 and the medium support 54. Moreover, since the recording medium 52 and the medium support 54 become less likely to be electrostatically charged, ink ejected from the recording head 51 is attached on the target position on the recording medium 52 with high accuracy. Accordingly, it is possible to prevent reduction in quality of image such as a recording image. Further, since the medium support 54 of this embodiment has a drum-shape, compared with the configuration which uses a plate-shaped support, it is possible to ensure a time for electrostatic discharge while it rotates (during the time period from when a portion of the outer peripheral surface of the medium support 54 faces the nozzle forming surface of the fifth recording head 51*e* at the time of ejection of ink from the fifth recording head 51*e* to when it is rotated to a position where it again faces the nozzle forming surface of the first recording head 51*a*) even if the recording medium 52 or the medium support 54 is electrostatically charged by the electrostatic ink ejected from the recording head 51. Accordingly, it is possible to reduce disadvantages due to electrostatic charging. Moreover, it is possible to more effectively reduce disadvantages due to electrostatic charging by providing the recording heads 51*a* to 51*e* with the same configuration as that of the recording head of any one of the first embodiment to the fourth embodiment.

Figure 12:
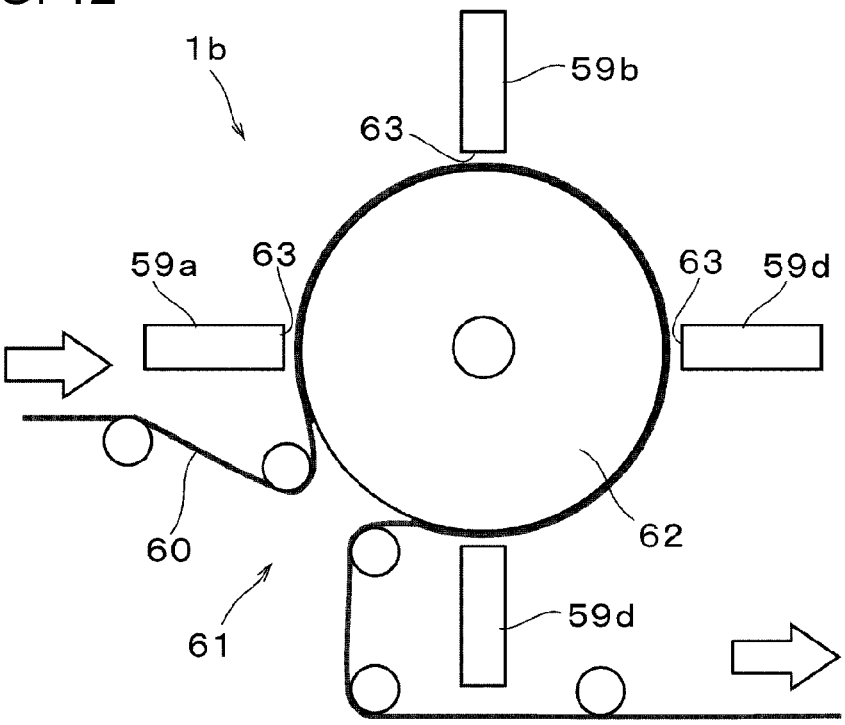
FIG. 12 is a schematic view which illustrates a configuration of the liquid ejecting apparatus in a sixth embodiment.

FIG. 12 is a schematic view which illustrated a configuration of the printer 1*b* in a sixth embodiment. The printer 1*b* of this embodiment is a so-called line-type printer, similarly to the printer 1*a* of the fifth embodiment. A recording medium 60 is a continuous sheet, and a transportation mechanism 61 that transports the recording medium 60 includes a drum-shaped medium support 62. The printer 1*b* of this embodiment includes a total of four recording heads 59*a* to 59*d*. The recording heads 59*a* to 59*d* are arranged along the outer peripheral surface of the medium support 54 with an equal interval (in this embodiment, each offset by 90 degrees from one another about the drive axis of the medium support 62) with the nozzle forming surface 63 facing the outer peripheral surface of the medium support 54. The recording medium 60 transported from the transportation mechanism 61 to the medium support 62 is supported by the medium support 62 at a position slightly close to the fourth recording head 59*d* from the first recording head 59*a* which is located on the most upstream among the recording heads 59 on the outer peripheral surface of the medium support 62, passes through between the outer peripheral surface of the medium support 62 and the respective recording heads 59 in sequence, and is discharged from the medium support 62 at a position slightly close to the first recording head 59*a* from the fourth recording head 59*d* which is located on the most downstream among the recording heads 59. Since the plurality of recording heads 59 are arranged along the outer peripheral surface of the medium support 62 with an equal interval, the space between the respective recording heads 59 can be expanded as possible. Accordingly, it is possible to ensure a time for electrostatic discharge between an ink ejection process (recording process) by one recording head 59 (located on the upstream side in the transport direction) and the subsequent ink ejection process by another recording head 59 (located on the downstream side in the transport direction). As a result, the recording medium 60 and the medium support 62 become less likely to be electrostatically charged even if the ejected ink has low electric conductivity and tends to be electrostatically charged, thereby reducing the possibility of ink (mist) being attached on a nozzle forming surface 55 of the recording head 51 due to the ink repelling the recording medium 60 and the medium support 62. This configuration is more effective when ink ejected from the respective recording heads 59 has low electric conductivity, or when the recording heads 59 cannot be arranged in descending order of electric conductivity of ink from upstream to downstream sides in the transport direction of the recording medium 60.

Although the ink jet recording head 10 has been described as an example of the liquid ejecting head in the above embodiments, the invention can be applied to the other liquid ejecting heads that eject liquid from the nozzle section. For example, the present invention can be applied to color material ejection heads used for manufacturing color filters for liquid crystal displays and the like, electrode material ejection heads used for manufacturing electrodes for organic electroluminescence (EL) displays, field emission displays (FEDs) and the like, and bioorganic ejection heads used for manufacturing biochips (biochemistry element) and the like. The color material ejecting heads for display manufacturing devices eject solution of color materials of red (R), green (G) and blue (B) as a type of liquid. Further, electrode material ejection heads for electrode forming apparatuses eject electrode materials in the liquid form as a type of liquid, and bioorganic ejection heads for biochip manufacturing apparatuses eject solution of bioorganic materials as a type of liquid.

The entire disclosure of Japanese Patent Application No. 2016-103152, filed May 24, 2016 is expressly incorporated by reference herein.

What is claimed is:

1. A liquid ejecting head comprising:

a nozzle plate that includes a nozzle forming surface to which a nozzle section through which liquid is ejected is open, the nozzle section forming a hole through the nozzle plate to allow the liquid to be ejected, wherein an electrostatic propensity of the nozzle section due to contact with the liquid is lower than an electrostatic propensity of the nozzle forming surface due to contact with the liquid, wherein the nozzle section includes a first region on an upstream side within the nozzle plate and a second region on a downstream side within the nozzle plate in an ejection direction of the liquid, the first region having a larger cross section than the second region, wherein both a liquid repellent film containing fluorine and a base film extend from the nozzle forming surface into the nozzle section of the nozzle plate such that an amount of fluorine per unit area decreases in an order of the nozzle forming surface, the second region, and the first region, and wherein the base film extends further into the nozzle section of the nozzle plate than the liquid repellent film and also extends only partially through the nozzle section.

2. The liquid ejecting head according to claim 1, wherein an amount of fluorine per unit area in the nozzle section is smaller than an amount of fluorine per unit area in the nozzle forming surface.

3. A liquid ejecting apparatus comprising the liquid ejecting head according to claim 2.

4. The liquid ejecting head according to claim 1, wherein the second region is formed on the nozzle forming surface, and the nozzle section is open to the second region.

5. A liquid ejecting apparatus comprising the liquid ejecting head according to claim 4.

6. The liquid ejecting head according to claim 1, wherein:

the liquid repellent film containing fluorine is formed on the nozzle forming surface and the second region, and a thickness of the liquid repellent film in the second region is smaller than a thickness of the liquid repellent film on the nozzle forming surface.

7. A liquid ejecting apparatus comprising the liquid ejecting head according to claim 6.

8. The liquid ejecting head according to claim 1, wherein:

the nozzle forming surface is made of a silicon substrate or a metal material, the liquid repellent film containing fluorine is formed on the nozzle forming surface via the base film, the base film includes a thin region having a thickness smaller than that of other portions, and the nozzle section is open to the thin region.

9. A liquid ejecting apparatus comprising the liquid ejecting head according to claim 8.

10. A liquid ejecting apparatus comprising the liquid ejecting head according to claim 1.

11. The liquid ejecting apparatus according to claim 10, further comprising:

a pressurizing unit that pressurizes a liquid supplying passage on an upstream side to the liquid ejecting head, wherein a cleaning process that discharges liquid from the nozzle section of the liquid ejecting head is performed by the pressurizing unit pressurizing the liquid supplying passage.

12. The liquid ejecting apparatus according to claim 10, further comprising:

a plurality of liquid ejecting heads, each configured to eject liquid having different electric conductivity from its corresponding nozzle section, and a transportation mechanism that transports an ejection target of the liquid, wherein the liquid ejecting heads are arranged in descending order of electric conductivity of the liquid from upstream to downstream sides in the transport direction of the ejection target.

13. The liquid ejecting apparatus according to claim 12, wherein the transportation mechanism includes a drum-shaped support that rotates while supporting the ejection target on an outer peripheral surface to thereby transport the ejection target.

14. A liquid ejecting apparatus comprising the liquid ejecting head according to claim 1.

15. A liquid ejecting head comprising:

a nozzle plate that includes a nozzle forming surface to which a nozzle section through which liquid is ejected is open, the nozzle section forming a hole through the nozzle plate to allow the liquid to be ejected, wherein an electrostatic propensity of the nozzle section due to contact with the liquid is lower than an electrostatic propensity of the nozzle forming surface due to contact with the liquid, wherein the nozzle section includes a first region on an upstream side within the nozzle plate and a second region, which diameter is smaller than or equal to the first region, on a downstream side within the nozzle plate in an ejection direction of the liquid, wherein both a liquid repellent film containing fluorine and a base film extend from the nozzle forming surface into the nozzle section of the nozzle plate, and wherein the base film extends further into the nozzle section of the nozzle plate than the liquid repellent film and also extends only partially through the nozzle section.

* * * * *